US009511480B1

(12) United States Patent
Ingram, Sr. et al.

(10) Patent No.: US 9,511,480 B1
(45) Date of Patent: Dec. 6, 2016

(54) DROPLESS DRYWALL SANDING BLOCK

(71) Applicants: Jesse Ingram, Sr., Cincinnati, OH (US); Brigitte Wicks, Sterling Heights, MI (US)

(72) Inventors: Jesse Ingram, Sr., Cincinnati, OH (US); Brigitte Wicks, Sterling Heights, MI (US)

( * ) Notice: Subject to any disclaimer, the term of this patent is extended or adjusted under 35 U.S.C. 154(b) by 0 days.

(21) Appl. No.: 14/523,767

(22) Filed: Oct. 24, 2014

Related U.S. Application Data

(60) Provisional application No. 61/895,947, filed on Oct. 25, 2013.

(51) Int. Cl.
*B24D 15/04* (2006.01)
*B24D 15/08* (2006.01)

(52) U.S. Cl.
CPC ..... *B24D 15/04* (2013.01); *B24D 15/08* (2013.01)

(58) Field of Classification Search
CPC ..... B24B 23/00; B24D 15/02; B24D 15/06; B24D 15/04; B24D 15/00
USPC ..... 451/523, 524, 526, 461, 462, 354
See application file for complete search history.

(56) References Cited

U.S. PATENT DOCUMENTS

| | | | | |
|---|---|---|---|---|
| 2,674,834 | A * | 4/1954 | Ehrsam | B24D 15/06 451/540 |
| 5,168,672 | A | 12/1992 | Gregoire, Sr. | |
| 5,412,830 | A * | 5/1995 | Girardot | A47K 7/02 15/118 |
| 6,439,988 | B1 | 8/2002 | Long et al. | |
| D497,092 | S | 10/2004 | McCarthy | |
| 7,014,550 | B2 | 3/2006 | Mansfield et al. | |
| D527,974 | S | 9/2006 | Petersen et al. | |
| 7,264,541 | B1 | 9/2007 | Ray et al. | |
| 7,364,501 | B2 | 4/2008 | Ali et al. | |
| 2003/0224708 | A1* | 12/2003 | Koenig, Jr. | B24D 15/02 451/461 |
| 2005/0059329 | A1 | 3/2005 | Stubbs | |
| 2009/0065538 | A1* | 3/2009 | Rodriquez | B24D 15/00 224/267 |

* cited by examiner

*Primary Examiner* — Robert Rose
(74) *Attorney, Agent, or Firm* — John D. Gugliotta

(57) ABSTRACT

An improved sanding block formed in a manner so as to have a beveled side to remove sanded debris or particles from the area that was just sanded, further comprising an inserted slit to remove knicks from drywall knives integrated into the side opposite from the beveled side, further comprising a strap for ease of use, transportation and preventing the sanding block from being dropped or misplaced.

4 Claims, 1 Drawing Sheet

DROPLESS DRYWALL SANDING BLOCK

RELATED APPLICATIONS

The present invention claims the benefit of U.S. Provisional Application No. 61/895,947, filed on Oct. 25, 2013, and incorporated by reference as if rewritten herein in its entirety.

BACKGROUND OF THE INVENTION

1. Field of the Invention

The present invention relates generally to sanding blocks and the ability to remove debris from walls and other tools and, more particularly, to a sanding block incorporating an inverted beveled edge for further providing a means of sharpening tools with knife blades and removing knicks from drywall.

2. Description of the Related Art

Sanding blocks have been in use in various forms for many years. Such blocks include sanding pads and sanding sponges of various sizes and shapes.

These sanding blocks can be made of a specific shape and design to serve a particular function. For example, a prior sanding block or sponge provides a shape that generally forms a point or apex so as to allow it to sand more efficiently into corners. A search of the prior art did not disclose any patents that read directly on the claims of the instant invention; however, the following references were considered related.

U.S. Pat. No. 7,364,501, issued in the name of Ali et al., discloses a sanding block that includes a compressible core having at least one pair of sides characterized such that an abrasive material is adhered to said sides substantially along the surface thereof and having a juncture area defined between said two sides which does not have said abrasive material adhered thereto such that the abrasive material does not run continuously about the sides of the core thereby providing the two sides to be readily compressed toward one another. A method of forming the same is also provided.

U.S. Pat. No. 7,014,550, issued in the name of Mansfield et al., discloses a sanding system comprising a detachable sanding pad with a plurality of sides adapted for different degrees of sanding retained in contact with a backing plate by teeth penetrating into opposed sides of the sanding pad. U.S. Pat. No. 5,168,672, issued in the name of Gregoire, Sr., discloses an abrasive paper sheet holder having a base provided with clamping shoulders formed in a pair of opposed side edges thereof. A handle member is detachably secured over a rear surface of the base. The handle member has opposed flexible flange walls for clamping opposed end edge portions of an abrasive paper sheet which is positioned over a front working surface of the base with the edge portions of the paper sheet extending over the clamping shoulders. The handle member applies a wedging pressure on the flexible flange walls to immovably clamp the opposed edge portions of the abrasive paper sheet between the end edges of the flexible flange walls and the clamping shoulders.

U.S. Pat. No. 7,264,541, issued in the name of Ray et al., discloses an improved drywall corner sander with an elongated body having opposite sides, and a pair of spaced apart braces extending between the sides. An axle is pivotally mounted between the braces so as to define a first longitudinal pivot axis. A tab on the axle defines a second, perpendicular pivot axis. A handle is connected to the tab of the axle so as to be pivotal about the first and second axes for easy operation of the sander without forming grooves in the side wall adjacent the outer edges of the sander. The pivot axes both reside within the cavity defined by the side walls of the sander.

U.S. Pat. D497,092, issued in the name of McCarthy, discloses an ornamental design for a corner sanding sponge.

U.S. Pat. D527,974 issued in the name of Petersen et al., discloses an ornamental design for a millwork sanding sponge.

U.S. Pat. No. 6,439,988, issued in the name of Long et al., discloses sanding tools made from a block of a foamed polymer sponge having two contiguous sides meeting at a right angle that are provided with an abrasive coating and which have in addition a means for grasping the tool formed in the body of the sponge so that the user can simultaneously sand two walls meeting to form a corner.

United States Patent Application 2005/0059329, filed in the name of Stubbs, discloses a direct-coated sponge abrasive material bearing a releasable securing means comprising one part of a two part hook and loop attachment system is provided.

However, in spite of all these improvements in the art, problems exist with a general or normal rectangular sanding block, including the pointed sanding block. One problem is sanding blocks or sponges are constantly dropped by the drywaller from various heights, thereby causing delays in production. Additionally, when a drywall finisher knicks his knife, additionally delays can occur due to imperfections in the finish work caused by the damaged knife. Further, the use of conventional rectangular drywall sanding blocks lack the ability to sharpen the various tools associated with drywall sanding.

Therefore, a need exists to provide a drywall sanding block sponge for convenience when performing drywall work, including providing a 'drop-less' drywall finishing sanding block that includes the ability to sharpen tools associated with sanding or the ability to remove knicks from the drywall knife, thereby preventing ridges in the finished product.

BRIEF SUMMARY OF THE INVENTION

Objectives of the invention includes providing an improved sanding block or sponge that utilizes an insert to remove knicks from knives.

It is a further objective of the present invention to provide a durable rubber handle to prevent dropping the sponge while performing drywall work.

Briefly described according to an exemplary embodiment of the present invention, an improved sanding block formed in a manner so as to have a beveled side to remove sanded debris or particles from the area that was just sanded. An inserted slit is formed, and functions to remove knicks from drywall knives integrated into the side opposite from the beveled side. A strap circumscribes one side for ease of use, transportation and preventing the sanding block from being dropped or misplaced.

These objectives and advantages are obtained by the sanding block/sponge of the present invention, the general nature of which may be stated as including a sanding block or sponge comprising: an inserted slit which can remove knicks from knives associated with applying tape or plaster when drywalling.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
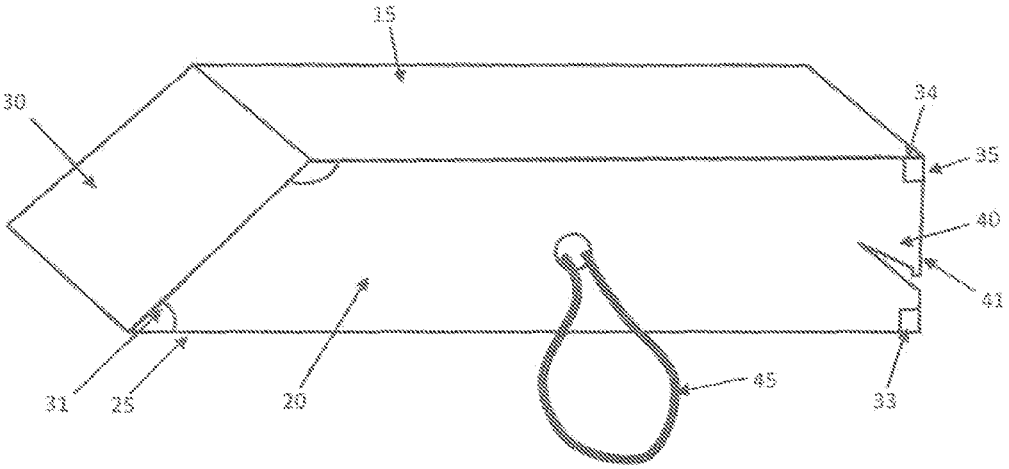
FIG. 1 is an isometric view of the sanding block of the present invention.

The improved sanding block of the present invention is indicated generally as 10 in FIG. 1 and is shown (without a slit or handle) in a neutral position as it is intended to be used. The sanding block 10 comprise six sides: a top surface 15, a bottom surface 25, a first side surface 20, a second side surface 21 (not shown in FIG. 1), a beveled side 30, and an opposite side 35. The totality of these connected surfaces create the sanding block 10.

The entire block is coated or covered with a surface that provides the ability to sand a surface. This is done with conventionally known methods and can be made in any amount of known sanding roughness (i.e. measure grit value, an example being 100 grit).

The top surface 15 is parallel with the bottom surface 25 of the sanding block 10. The first side surface 20 and the second side surface 21 are parallel to each other. It is anticipated that top surface 10 an the bottom surface 25 connect with the first side surface 20 and second side surface 21 to interior angles 50. It is anticipate that the interior angle 50 will form right angles of 90 degrees, however, other angled possibilities are available, such as 30, 60, 120, 150, or other degrees.

The beveled side 30 connects with the bottom surface 25 and forms a first connection angle 31. This first connection angle 31 is an acute angle. The beveled side 30 connects with the top surface 15 and forms a second connection angle 32. This second connection angle 32 is an obtuse angle.

A strap 45 may be attached to the sanding block 10. The strap may be made of any conventionally known material, however it is anticipated that the strap will have elastic properties. The strap 45 is also able to with stand significant forces without breaking. The strap 45 may be attached to any of the six sides of the sanding block, however it is anticipated that the strap 45 will be attached to either the first side surface 20, the second side surface 21, or the top surface 15.

The opposite side 35 connects with the bottom surface 25 and forms a third connection angle 33. This third connection angle 33 is a right angle. The opposite side 35 connects with the top surface 15 and forms a fourth connection angle 34. This second connection angle 34 is a right angle.

Integrated into the opposite side is an insert or slit 40 that functions to remove knicks from drywall knives. The insert or slit 40 has a sharpener opening 41 that is coplanar with the top surface 15 and bottom surface. The sharpener 40 is invertedly tapered up towards the top surface 15 so as to create a means for sharpening a tool, such as a knife.

Figure 2:
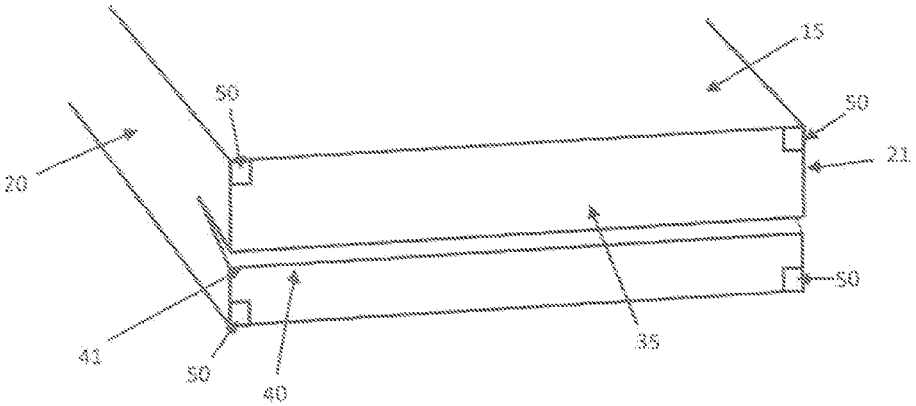
FIG. 2 is an end perspective view of the sanding block of the present invention, showing the edge containing the edge 40 that removes knicks from drywalling knives.

FIG. 2 is a perspective view showing the opposite side 35 and the knife insert opening 41 running coplanar with the top surface 15. Further depicted is the top surface 15 connecting with first side surface 20 and the second side surface 21.

2. Operation of the Preferred Embodiment

In operation, the present invention is used to sand and to remove debris from walls and other tools. Further, using the inverted beveled edge, tools, such as knife blades, can be sharpened knicks can be removed from drywall. Further still, the durable rubber handle is provided to prevent dropping the sponge while performing drywall work.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. An improved sanding block comprising:

a top surface, a bottom surface, a first side surface, a second side surface, a beveled side surface, and an opposite side surface;

wherein the top surface and the bottom surface are parallel;

wherein said first side surface and said second side surface are parallel;

wherein the top and bottom surface connect with the two side surfaces to form interior angles;

wherein the beveled side surface connects with the bottom surface to form a first angle, and the beveled side surface connects with the top surface to create a second angle; and a nick remover, wherein the nick remover is integrated as an insert within a slit formed within said opposite side surface into the opposite side surface.

2. The sanding block of claim 1, where the first angle is an acute angle.

3. The sanding block of claim 2, where the second angle is an obtuse angle.

4. The sanding block of claim 3, where the interior angles are 90 degrees.

* * * * *